US005659866A

United States Patent [19]

Kim

[11] Patent Number: 5,659,866

[45] Date of Patent: Aug. 19, 1997

[54] FIXING HEAT ROLLER OF ELECTROPHOTOGRAPHIC RECORDING SYSTEM

[75] Inventor: Sung-Gi Kim, Seoul, Rep. of Korea

[73] Assignee: SamSung Electronics Co., Ltd., Kyungki-do, Rep. of Korea

[21] Appl. No.: 522,154

[22] Filed: Aug. 31, 1995

[30] Foreign Application Priority Data

Oct. 7, 1994 [KR] Rep. of Korea ..... 1994-25702

[51] Int. Cl.[6] ..... G03G 15/20

[52] U.S. Cl. ..... 399/330; 492/46

[58] Field of Search ..... 432/60; 492/46; 355/282, 285, 289, 290; 219/469, 216; 399/330

[56] References Cited

U.S. PATENT DOCUMENTS

| | | | |
|---|---|---|---|
| 4,284,875 | 8/1981 | Namiki et al. | 219/216 |
| 4,348,579 | 9/1982 | Namba | 219/216 |
| 4,377,336 | 3/1983 | Parks et al. . | |
| 4,443,689 | 4/1984 | Muller et al. | 219/469 |
| 4,459,726 | 7/1984 | O'Brien et al. . | |
| 4,766,288 | 8/1988 | Berkes et al. | 219/216 |
| 5,184,153 | 2/1993 | Daniels et al. . | |
| 5,212,528 | 5/1993 | Matsuda | 355/285 |
| 5,298,957 | 3/1994 | Haupt et al. | 355/285 |
| 5,315,359 | 5/1994 | Nishikawa | 355/315 |
| 5,402,211 | 3/1995 | Yoshikawa | 355/285 |
| 5,426,495 | 6/1995 | Sawamura et al. | 355/285 |

FOREIGN PATENT DOCUMENTS

| | | | |
|---|---|---|---|
| 470276 | 2/1992 | European Pat. Off. | 355/289 |
| 04371984 | 12/1992 | Japan | 355/289 |

*Primary Examiner*—Robert Beatty
*Attorney, Agent, or Firm*—Robert E. Bushnell, Esq.

[57] ABSTRACT

A heat fixing roller in an electrophotographic recording system provides a high degree of radiating efficiency and reduces the amount of time it takes for the heat fixing roller to achieve a temperature necessary to perform a printing operation. The heat fixing roller has a heat lamp installed along a center axis within an interior portion of the heat fixing roller. A plurality of hollowed-out heat conduits extend outwardly in a radial manner from the heat lamp to provide a path through which heat generated by the heat lamp can radiate to rapidly increase the temperature of an outer surface of the heat fixing roller.

17 Claims, 3 Drawing Sheets

FIXING HEAT ROLLER OF ELECTROPHOTOGRAPHIC RECORDING SYSTEM

CROSS-REFERENCE TO RELATED APPLICATIONS

This application makes reference to, incorporates the same herein, and claims all benefits accruing under 35 U.S.C. §119 from an application for Heat Fixing Roller Of Electrophotographic Recording System earlier filed in the Korean Industrial Property Office on 7 Oct. 1994 and assigned Ser. No. 25702/1994.

BACKGROUND OF THE INVENTION

The present invention relates to a heat fixing roller in an electrophotographic recording system, and more particularly to a heat fixing roller in an electrophotographic recording system having a high degree of heat radiating efficiency by providing a plurality of heat conduits within an interior portion of the heat fixing roller.

Heat fixing rollers are widely used in electrophotographic recording systems, such as laser beam printers, copying machines and facsimile machines, to securely fix developing material (i.e., toner) upon a surface of a printable medium, such as paper. To ensure proper adhesion of the toner upon the surface of the printable medium, it is essential that the heat fixing roller be pre-heated to a temperature adequate to perform the toner fixing operation. In many cases, this process of pre-heating can be unduly time consuming, thereby causing an inconvenience to a user who is waiting to use the system. Accordingly, it is quite desirable for the heat fixing roller to be capable of being rapidly heated to the temperature necessary for proper toner fixation.

One prior art reference that seeks to provide a heat fixing roller capable of rapidly reaching a predetermined operating temperature is disclosed in U.S. Pat. No. 5,426,495 entitled Image Fixing Device Having Heating Portion At One End Thereof issued to Sawamura et al. on 20 Jun. 1995. In Sawamura et al. '495, an image fixing device has a hollow cylindrical fixing roller implemented as a heat pipe, and a pressing roller held in pressing contact with the fixing roller. The fixing roller is made up of a fixing portion, and a paper nipping portion against which the pressing roller is constantly urged. This configuration purportedly promotes rapid heat conduction from a halogen heater to a working fluid filled in the heat pipe. While conventional art, such as Sawamura et al. '495, has merit in its own right, I believe that a simplier means for enhancing heat conductivity exists.

SUMMARY OF THE INVENTION

It is therefore an object of the present invention to provide an improved heat fixing roller in an electrophotographic recording system.

It is another object to provide a heat fixing roller that provides a high degree of heat radiating efficiency.

It is still another object to provide a heat fixing roller that reduces the amount of time required to reach a temperature necessary to perform an image fixing operation.

It is yet another object to provide a heat fixing roller having a plurality of heat conduits formed on an interior portion of the heat fixing roller.

These and other objects can be achieved in accordance with the principles of the present invention with a heat fixing roller having a heat lamp installed along a center axis within an interior portion of the heat fixing roller. A plurality of hollowed-out heat conduits extend outwardly in a radial manner from the heat lamp to provide a path through which heat generated by the heat lamp can radiate to rapidly increase the temperature of an outer surface of the heat fixing roller. The heat fixing roller is installed within an electrophotographic recording system, provides a high degree of radiating efficiency, and reduces the amount of time it takes for the heat fixing roller to achieve a temperature necessary to perform a printing operation.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
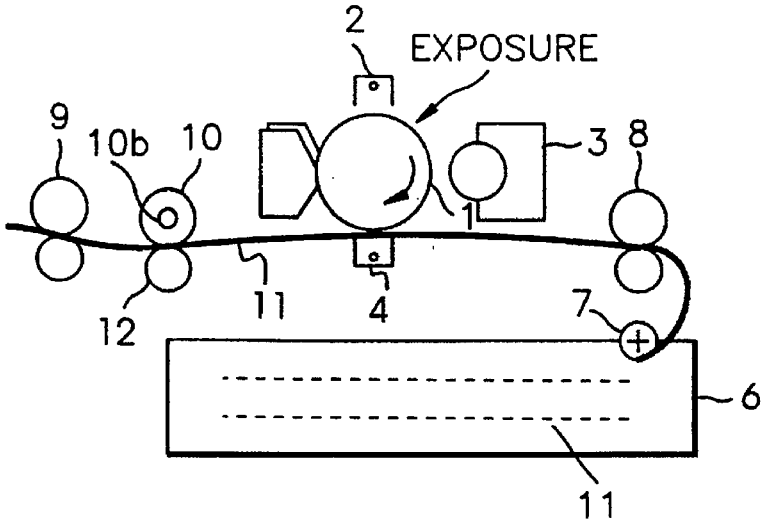
FIG. 1 is a schematic view illustrating an electrophotographic recording system.

Turning now to the drawings and referring to FIG. 1, the operations of an electrophotographic recording system will be briefly explained. An outer surface of a photosensitive drum 1 is electrically charged by the corona discharge of a charging unit 2. The charged outer surface of photosensitive drum 1 is then exposed to light as the photosensitive drum 1 rotates and an electrostatic latent image is thus formed on the exposed outer surface. The electrostatic latent image is developed with toner while passing a developing unit 3 during the rotation of photosensitive drum 1, thereby producing a visible image on the outer surface of photosensitive drum 1. The visible image is then transferred onto a printable medium 11, such as paper, by a transfer unit 4 after the printable medium 11 is fed from a paper cassette 6 by a feeding roller 7 and passes through a set of register rollers 8. The printable medium 11 containing the transferred image is then conveyed to a fixing unit and passes between a heat roller 10 and a press roller 12. The printable medium 11 is finally ejected from the electrophotographic recording system by a set of ejecting rollers 9. At the fixing unit, toner is fixed onto a surface of printable medium 11 by the heat and pressure of the fixing unit. To perform the fixing operation, heat generated from a heat lamp **10*b* positioned within an interior of heat roller 10 must reach a predetermined fixing temperature so that the surface of heat roller 10 exhibits a temperature necessary to secure the toner upon the surface of printable medium 11**.

Figure 2:
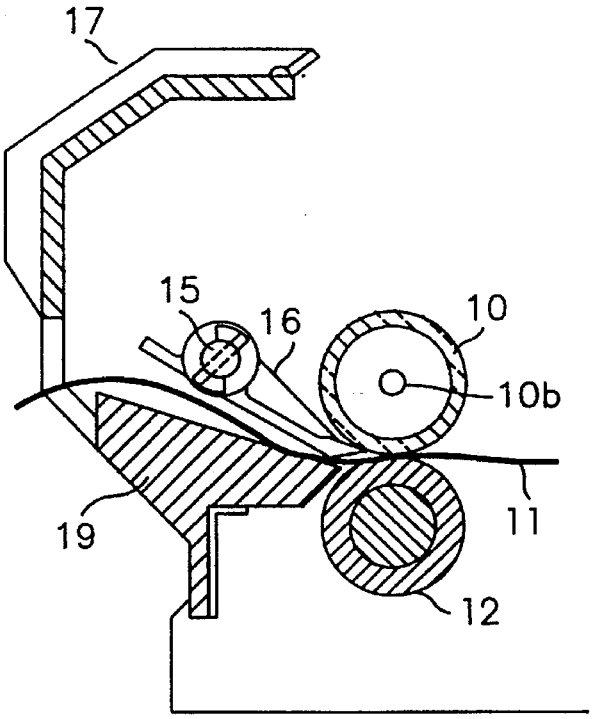
(PRIOR ART) FIG. 2
FIG. 2 is a view illustrating a heat fixing roller in a conventional electrophotographic recording system.

Referring now to FIG. 2, the construction and operation of heat roller 10 and press roller 12 of FIG. 1 will now be described. Note that this construction and operation is similar to what is disclosed in U.S. Pat. No. 5,315,359 issued on May 24, 1994 to Nishikawa.

An outer surface of heat roller 10 has a thickness of about 1.5 mm and heat lamp **10*b* is formed within an interior portion of heat roller 10. Heat generated by heat lamp 10*b* radiates outwardly to heat the outer surface of heat roller 10. As a result, toner can be fixedly secured upon the surface of printable medium 11 by the heat of heat roller 10 and the pressure of press roller 12. The electrophotographic recording system of FIG. 2 also includes a paper jam prevention claw 16 pivotally installed upon a shaft 15 for preventing printable mediums 11 from becoming jammed, a discharge guide 19 for guiding the printable mediums 11 as they are ejected from the system, and a cover 17** for covering and protecting the interior of the system.

In FIG. 2, the distance between heat lamp **10*b* and the outer surface of heat roller 10 is one factor governing how long heat roller 10 will take to reach the temperature necessary to perform the toner fixing operation. That is, the larger the distance between heat lamp 10*b* and the outer surface of heat roller 10, the longer it will take heat roller 10 to reach the temperature necessary to perform the toner fixing operation. The amount of time it takes for heat roller 10** to reach the temperature necessary to perform the toner fixing operation is typically referred to as the "warm-up time".

In conventional devices, such as the one shown in FIG. 2, the outer surface of heat roller 10 must reach a temperature of 168°, and the warm-up time is approximately 45 seconds. Consequently, there is a problem in that this warm-up time is often inconveniently long.

In order to reduce the warm-up time, that is, to minimize the distance between the outer surface of heat roller 10 and heat lamp **10*b*, a method has been proposed for reducing the thickness of the outer surface of heat roller 10. With this method, however, when the thickness of the outer surface of heat roller 10 is reduced, the amount of pressure exerted upon printable medium 11 is reduced. Therefore, printable mediums 11 may curl up as they are ejected from the system, and a fixing characteristic of heat roller 10** deteriorates.

To compensate for this adverse effect, the pressure exerted upwardly by press roller 12 should be increased. Increasing this pressure, however, may increase the amount of pressure exerted upon heat roller 10 and a gear that drives heat roller 10. Accordingly, the conditions required for driving heat roller 10 deteriorate.

Figure 3A:
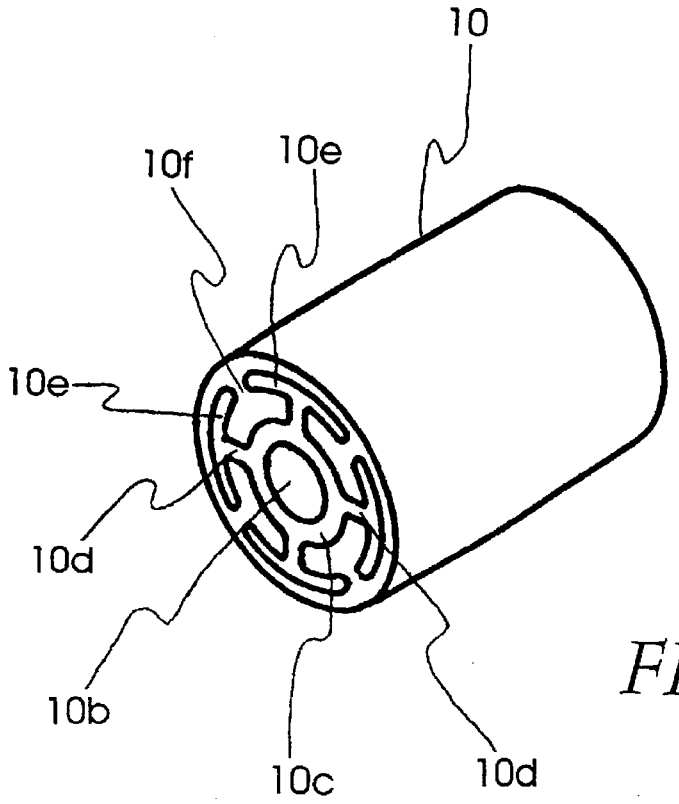
FIG. 3A and FIG. 3B are cross-sectional perspective views illustrating embodiments of heat fixing rollers constructed according to the principles of the present invention.
Figure 3B:
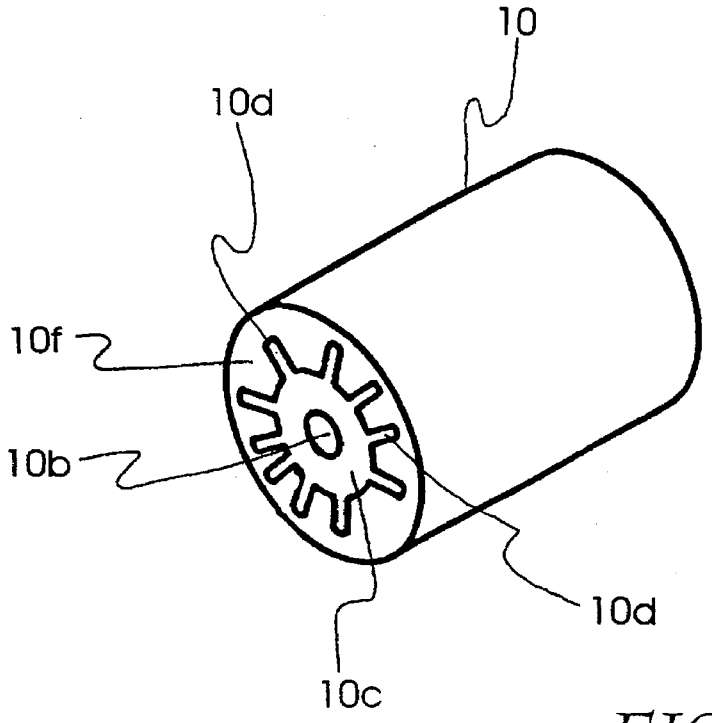

Referring now to FIGS. 3A and 3B, cross-sectional perspective views illustrating embodiments of heat fixing rollers 10 constructed according to the principles of the present invention are shown.

Heat fixing rollers 10 each include a heat lamp **10*b* that is positioned within an interior portion of heat fixing roller 10 and extends coextensively with a center axle of heat fixing roller 10. Heat lamp 10*b* generates the heat that enables heat fixing roller 10 to secure toner upon the surface of the printable medium that engages heat fixing roller 10. A hollow ring 10*c* is positioned circumferentially about heat lamp 10*b* and provides a space through which the heat generated by heat lamp 10*b* immediately radiates. A plurality of hollow heat conduits 10*d* also positioned within the interior of heat fixing roller 10 extend radially from heat lamp 10*b* and hollow ring 10*c* and provide a path through which the heat generated by heat lamp 10*b* can propagate to increase the temperature of an outer surface of heat fixing roller 10, and thereby facilitate the toner fixing operation. Each of the heat conduits 10*d* of the embodiment of the present invention shown in FIG. 3A further includes an arcuate member 10*e* that extends partially in a circumferential manner with the outer surface of heat fixing roller 10. A solid material 10*f* makes up those remaining portions of the interior of heat fixing roller 10 that are not occupied by heat lamp 10*b*, hollow ring 10*c*, heat conduits 10*d* and arcuate members 10*e* (embodiment of FIG. 3A only). Heat fixing rollers 10 also include end walls (not shown in drawings) upon which heat lamps 10*b* and the center axle of heat fixing rollers 10 attach. That is, hollow ring 10*c* and heat conduits 10*d* (and arcuate members 10*e* in FIG. 3A) are not visible from the exterior of heat rollers 10. According to these embodiments, heat generated by heat lamp 10*b* can be effectively and efficiently transferred to the outer surface of heat fixing roller 10**.

Figure 4:
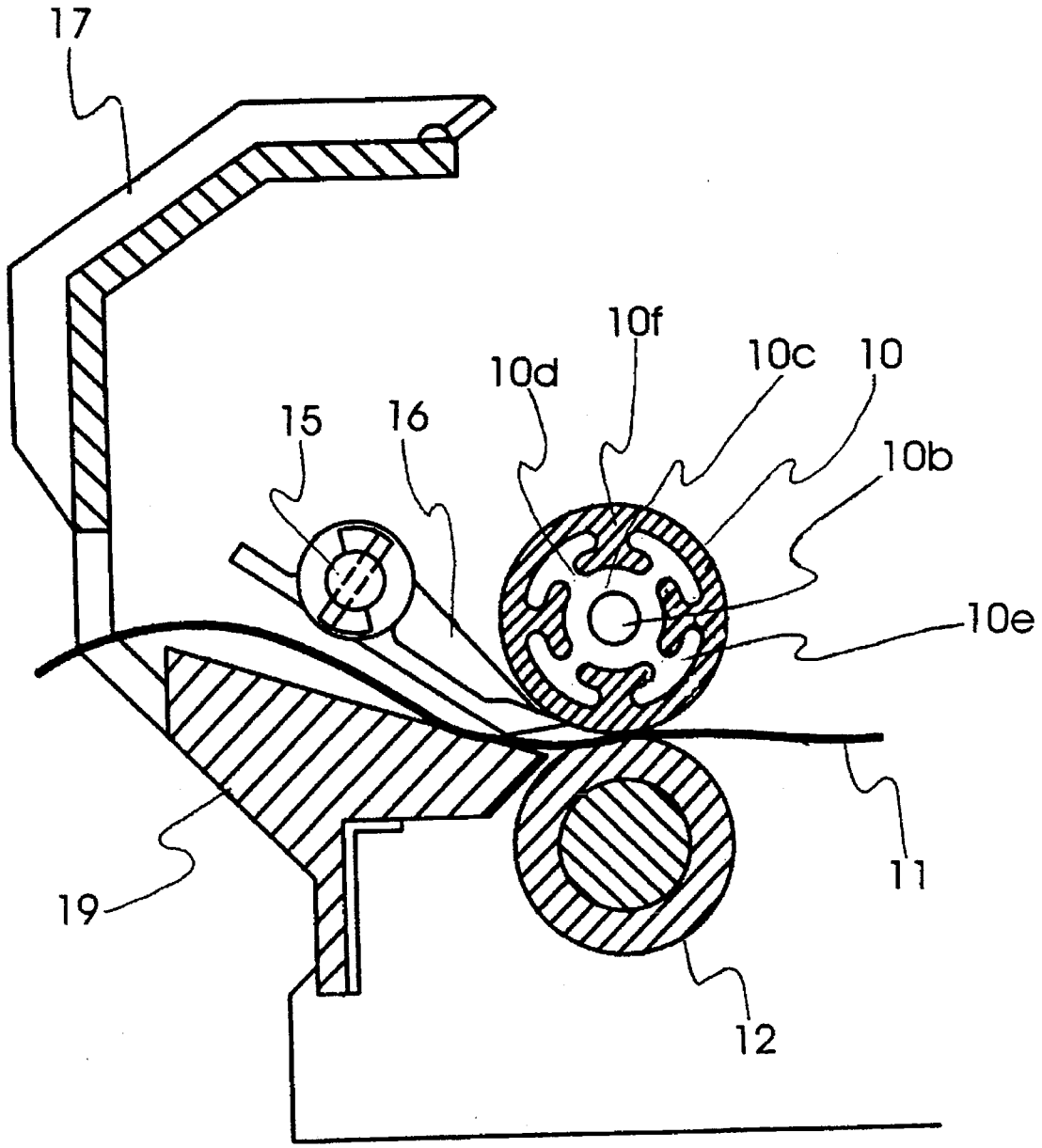
FIG. 4 is a cross-sectional view illustrating one embodiment of a heat fixing roller in an electrophotograpic recording system constructed according to the principles of the present invention.

Referring to FIG. 4, a cross-sectional view illustrating one of the embodiments of heat fixing roller 10 in an electrophotographic recording system constructed according to the principles of the present invention is shown.

In FIG. 4, the embodiment of heat roller 10 shown in FIG. 3A is illustrated in an installed position within an electrophotographic recording system. As in FIG. 2, conventional elements such as pressure roller 12, paper jam prevention claw 16 pivotally installed upon shaft 15 for preventing printable mediums 11 from becoming jammed, discharge guide 19 for guiding the printable mediums 11 as they are ejected from the system, and cover 17 for covering and protecting the interior of the system, are also included in the electrophotographic recording system of the present invention. In FIG. 4, heat generated by heat lamp **10*b* propagates through hollow ring 10*c*, heat conduits 10*d* and arcuate members 10*e*, to thereby heat the outer surface of heat fixing roller 10. Pressure roller 12 exerts an upward force upon printable medium 11 as it passes between heat fixing roller 10 and pressure roller 12. Accordingly, the heat transferred from heat fixing roller 10, in combination with the upward force applied by pressure roller 12, securely fixes toner upon the surface of printable medium 11**.

As explained above, the present invention provides advantages in that a heat fixing roller in an electrophotographic recording system is capable of quickly reaching a temperature adequate to perform a toner fixing operation, thereby reducing the amount of time a user must wait to perform a printing operation.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. A heat fixing roller in an electrophotographic recording system, said heat fixing roller comprising:

a heat lamp positioned within an interior of said heat fixing roller and extending along a center axis of said heat fixing roller, said heat lamp generating heat to enable said heat fixing roller to secure toner upon a surface of a printable medium engaging said heat fixing roller; and a plurality of heat conduits positioned within said interior of said heat fixing roller, said plurality of heat conduits extending radially from said heat lamp for providing a path through which the heat generated by said heat lamp can propagate to increase a temperature exhibited by an outer surface of said heat fixing roller, each one of said heat conduits having an arcuate member extending partially circumferentially with said outer surface of said heat fixing roller.

2. The heat fixing roller as claimed in claim 1, further comprising a solid material disposed between said heat conduits and said outer surface of said heat fixing roller.

3. The heat fixing roller as claimed in claim 2, wherein each one of said plurality of heat conduits comprises a hollow region.

4. The heat fixing roller as claimed in claim 1, further comprising a hollow ring extending circumferentially about said heat lamp for receiving the heat generated by said heat lamp and transferring the heat to said plurality of heat conduits extending radially from said hollow ring.

5. A heat fixing roller in an electrophotographic recording system, said heat fixing roller comprising:

a heat lamp positioned within an interior of said heat fixing roller and extending along a center axis of said heat fixing roller, said heat lamp generating heat to enable said heat fixing roller to secure toner upon a surface of a printable medium engaging said heat fixing roller;

a hollow ring positioned circumferentially about said heat lamp for receiving the heat generated by said heat lamp; and a plurality of heat conduits positioned within said interior of said heat fixing roller, said plurality of heat conduits extending radially from said hollow ring for receiving the heat from said hollow ring and providing a path through which the heat can propagate to increase a temperature exhibited by an outer surface of said heat fixing roller, each one of said heat conduits having an arcuate member extending partially circumferentially with said outer surface of said heat fixing roller.

6. The heat fixing roller as claimed in claim 5, further comprising a solid material disposed between said heat conduits and said outer surface of said heat fixing roller.

7. The fixing heat roller as claimed in claim 6, wherein each one of said plurality of heat conduits comprises a hollow region.

8. An electrophotographic recording system, comprising:

a heat fixing roller for engaging and applying heat upon a surface of a printable medium to securely fix developing material upon said surface of said printable medium, said heat fixing roller comprising:

a heat lamp positioned within an interior of said heat fixing roller and extending along a center axis of said heat fixing roller, said heat lamp generating heat to enable said heat fixing roller to secure said developing material upon said surface of said printable medium as said printable medium engages said heat fixing roller; and a plurality of heat conduits positioned within said interior of said heat fixing roller, said plurality of heat conduits extending radially from said heat lamp for providing a path through which the heat generated by said heat lamp can propagate to increase a temperature exhibited by an outer surface of said heat fixing roller, each one of said heat conduits having an arcuate member extending partially circumferentially with said outer surface of said heat fixing roller; and a pressure roller for engaging and exerting a force upon said printable medium as said printable medium passes between said heat fixing roller and said pressure roller.

9. The electrophotographic recording system as claimed in claim 8, further comprising a solid material disposed between said heat conduits and said outer surface of said heat fixing roller.

10. The electrophotographic recording system as claimed in claim 8, wherein each one of said plurality of heat conduits comprises a hollow region.

11. The electrophotographic recording system as claimed in claim 9, wherein each one of said plurality of heat conduits comprises a hollow region.

12. The heat fixing roller as claimed in claim 8, further comprising a hollow ring extending circumferentially about said heat lamp for receiving the heat generated by said heat lamp and transferring the heat to said plurality of heat conduits extending radially from said hollow ring.

13. The electrophotographic recording system as claimed in claim 12, wherein each one of said plurality of heat conduits comprises a hollow region.

14. A heat fixing roller in an electrophotographic recording system, said heat fixing roller comprising:

a heat lamp positioned within an interior of said heat fixing roller and extending along a center axis of said heat fixing roller, said heat lamp generating heat to enable said heat fixing roller to secure toner upon a surface of a printable medium engaging said heat fixing roller; and a plurality of heat conduits positioned within said interior of said heat fixing roller, said heat conduits extending radially from said heat lamp for providing a path through which the heat generated by said heat lamp can propagate to increase a temperature exhibited by an outer surface of said heat fixing roller, each one of said heat conduits exhibiting a width that is less than a distance separating adjacent ones of the heat conduits.

15. The heat fixing roller as claimed in claim 14, wherein each one of said heat conduits comprises a hollow region.

16. The heat fixing roller as claimed in claim 14, further comprising a hollow ring extending circumferentially about said heat lamp for receiving the heat generated by said heat lamp and enabling transfer of the heat to said heat conduits.

17. The heat fixing roller as claimed in claim 14, wherein each one of said heat conduits further comprises an arcuate member extending partially circumferentially with said outer surface of said heat fixing roller.

* * * * *